US006164031A

United States Patent [19]

Counihan

[11] Patent Number: 6,164,031

[45] Date of Patent: Dec. 26, 2000

[54] RESILIENT FLOORING

[76] Inventor: James Counihan, 50 Griffin Mill Rd., Piedmont, S.C. 29673

[21] Appl. No.: 09/290,537

[22] Filed: Apr. 12, 1999

[51] Int. Cl.[7] ..... E04B 5/00

[52] U.S. Cl. ..... 52/480; 52/489.1; 52/391; 52/393; 52/368; 52/403.1

[58] Field of Search ..... 52/480, 489.1, 52/391, 393, 368, 403.1

[56] References Cited

U.S. PATENT DOCUMENTS

| | | | |
|---|---|---|---|
| 2,167,836 | 8/1939 | Greulich | 189/40 |
| 2,424,986 | 1/1947 | Tinnerman | 24/81 |
| 2,882,560 | 4/1959 | Plendl | 20/8 |
| 3,271,916 | 9/1966 | Omholt | 52/393 |
| 3,553,919 | 1/1971 | Omholt | 52/483 |
| 3,596,422 | 8/1971 | Boettcher | 52/368 |
| 4,170,859 | 10/1979 | Counihan | 52/763 |
| 4,599,842 | 7/1986 | Counihan | 52/586 |
| 5,016,413 | 5/1991 | Counihan | 52/391 |
| 5,369,927 | 12/1994 | Counihan | 52/403.1 |
| 5,412,917 | 5/1995 | Shelton | 52/403.1 |
| 5,609,000 | 3/1997 | Niese | 52/480 |
| 5,906,082 | 5/1999 | Counihan | 52/403.1 |

*Primary Examiner*—Carl D. Friedman
*Assistant Examiner*—Christy M. Syres
*Attorney, Agent, or Firm*—Flint & Kim, P.A.

[57] ABSTRACT

A resilient flooring formed over a base floor which includes a plurality of parallel spaced channel members secured with the base floor. Each channel member which forms a channel includes a base, spaced vertical sides and inwardly directed rims secured at upper ends of each of said sides. At least one resilient member is positioned between adjacent of the channel members and sub-floor panels are arranged between the channel members over the resilient member. Opposed ends of the sub-floor panels adjacent the channel members are formed with a recessed shoulder. Adjacent shoulders form a groove across the sub-floor panels. Flooring strips are secured with the sub-floor panels forming a flooring surface. Clips which engage the rims of the channel members and with the shoulders of the sub-flooring panels, act to secure the resilient flooring a maximum position away from the base floor while allowing movement toward the base floor.

22 Claims, 4 Drawing Sheets

RESILIENT FLOORING

BACKGROUND OF THE INVENTION

This invention is directed to resilient flooring systems secured to a base floor by channel members. Resilient floor systems are old and well known throughout the industry. Two illustrative systems are disclosed in U.S. Pat. Nos. 5,016,413 and 5,369,927 to Counihan.

In a first of these systems, resilient sub-flooring panels are secured with the base floor by way of elongated fastening strips while in the second system a sleeper system is secured to the base floor by way of spaced floor clips. In each system, the securing members are a unique and integral part of the system and are individually secured to the base floor as a first step.

Also, channel secured flooring systems are old and well known throughout the industry. U.S. Pat. Nos. 3,271,916 and 3,553,919 are illustrative of these flooring systems. In each a channel member is secured to a base floor. Flooring strips are laid transversely of and supported by the channel members. Clips secure with the flooring strips and the channel members to secure the flooring strips with the base floor. This second system has not proved to be particularly satisfactory and is routinely replaced by systems similar to those earlier described.

Presently, when a second type system is replaced, the entire system is removed from the base floor to include the channel members. The securing system for a first type system is then installed. The exchange of securing systems is a labor intensive and costly operation.

It is an object of the instant invention to provide a resilient flooring system which incorporates a portion of the securing system of the flooring system upward movement of the flooring system while allowing controlled downward movement thereof.

Another object of the invention is a securing system which is easily installed.

Another object of the invention is a resilient flooring system which utilizes channel members in its receiving system.

Another object of the invention is a securing system which utilizes clips which engage with channel members and with sub-floor panels arranged over a resilient support.

Another object of the invention is a securing system which limits disclosed in the first arrangement.

SUMMARY OF THE INVENTION

The instant invention is directed to a resilient flooring system formed over a base floor which includes a plurality of parallel spaced channel members secured with the base floor. Each channel member includes a base and spaced vertical sides carrying at their upper ends inwardly directed rails. Inner ends of the rails define the opening into the channel of the channel member. There is provided at least one resilient member between adjacent of the channel members which support sub-floor panels also arranged between the channel members.

Opposed ends of the sub-floor panels adjacent the channel members are formed with a recessed shoulder which extends transversely thereof. Adjacent shoulders form a groove across the sub-floor panels. Flooring strips are positioned transversely of the grooves and are secured with the sub-floor panels forming a flooring surface.

Clips, which engage beneath the rails of the channel members and over the shoulders of the sub-flooring panels, are provided. These clips act to secure the resilient flooring in a maximum position away from the base floor while allowing movement toward the base floor. The clips are spaced along the channels by between 6" and 24".

Each clip comprises a linear body which has a perpendicularly directed finger at its upper end and a perpendicularly directed foot at its lower end. The finger is adapted to engage over the shoulder of the adjacent sub-floor panel and the foot is adapted to engage under an adjacent rail of the channel member. The finger and the foot are constructed to extend in the same direction away from the body of the clip.

The clips are arranged in opposed pairs which are maintained separated by a spacer. The spacer may comprise a strip of foam or a piece of fiber board.

A second construction for the clip includes a lower leg extending perpendicularly of the body adjacent its lower end and in a direction opposite to the direction of extension of the foot. The leg has at its end remote the foot a vertical extension having an outwardly directed spur. This clip secures with both rails of the channel member with the foot positioned beneath a first rail and the spur beneath a second of the rails. These clips are preferably staggered along the channel members with alternate ones engaging with alternate of the shoulders of the opposed sub-floor panels.

The base floor is normally formed of concrete and may or may not be covered with fiber board. The channel member is normally formed of 16 gauge steel while the clip is normally formed of resilient 18 gauge steel.

Another construction of the clip comprises a pair of spaced linear body members engaged at a first end with a spacer member. The spaced body members are laterally and resiliently separated. A finger extends perpendicularly from the first end of each body member in axial alignment with the spacer member. A foot extends from the second end of each body member in parallel alignment with the fingers. These clips secure the resilient flooring with the base floor with each of the feet engaged beneath a rails of the channel member and each of the fingers engaged over an adjacent shoulder of the opposed sub-floor panels. A resilient spacer may be located between the body members to urge them outwardly against the rails.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
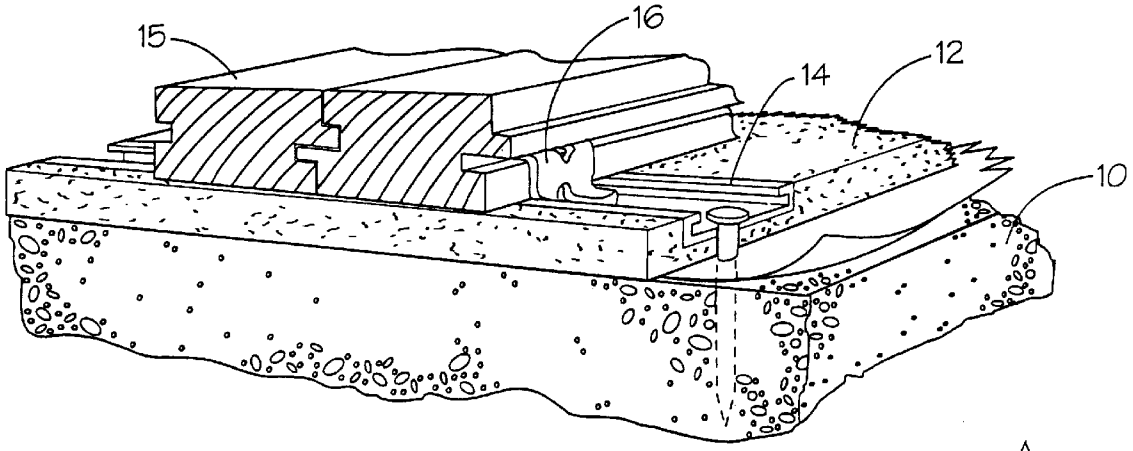
Fig. 1 PRIOR ART
FIG. 1 is a perspective sectional view of the prior art.

Turning now to the drawings, FIG. 1 shows a known flooring system using a channel securing system. Particularly, this system includes a concrete base floor 10, having a sub-floor of fiber board 12 laid thereover. Parallel spaced grooves are provided to receive channel members 14 which are secured with the base floor. Flooring strips 15 are laid transversely of the channel members and secured in position by clips 16. The clips are designed to engage beneath the rails of channel members 14 and within the groove beneath selected of the tongue an groove flooring strips 15.

Figure 2:
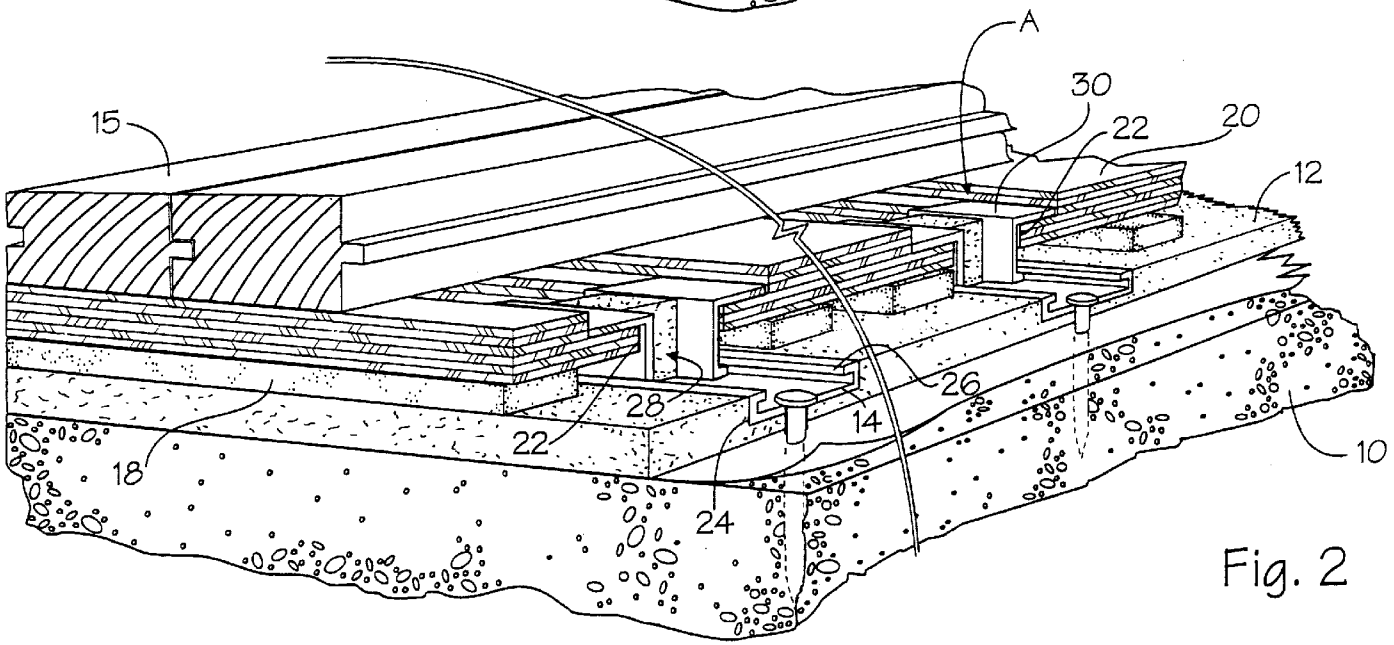
FIG. 2 is a perspective sectional view of a first arrangement of the resilient flooring system of the invention.

A first embodiment of the securing system for the resilient flooring system of the invention is shown in FIGS. 2 and 3. As shown in FIG. 2, a channel flooring as shown in FIG. 1 has been removed leaving a fiber board covering 12 overlaying a concrete base floor 10. Spaced and parallel channel members 14, shown seated in grooves formed in fiber board 12, have a resilient panel or a plurality of resilient strips arranged in the area between the spaced channel members. Resilient members 18, which are about ½" thick, may be rubber, foam, or other suitable material. Sub-flooring panels 20, which are formed preferably of ½" plywood paneling, are positioned over resilient members 18 across the base floor in edge to edge contact and with opposed ends 22 positioned adjacent opposed side walls 24 of channel members 14 forming slot 28.

It is noted that channel member 14 could be secured directly with base floor 10 with no fiber board 12 being present or it could be between fiber boards. Channel members 14 are formed preferably of 16 guage steel with a base of about 1" positioned on base floor 10. Side walls 24, which are connected with outer edges of the base, extend upwardly about ¼". Upper rails 26, which extend inwardly from each side by about ⅛", are formed with upper edges of each side wall. Opposed inner faces of rails 26 define the opening into the channel of the channel member.

Upper edges of each sub-flooring panel 20, along opposed ends are cut to form a recessed shoulder 30 and a widened groove 32 along the upper edge of slot 28.

Groove 32 is recessed by about ¼" from the upper surface of panels 20. Flooring strips 15 are positioned tongue in groove and fastened with the sub-floor panels in a ususal manner, such as brads or nails.

Figure 4A:
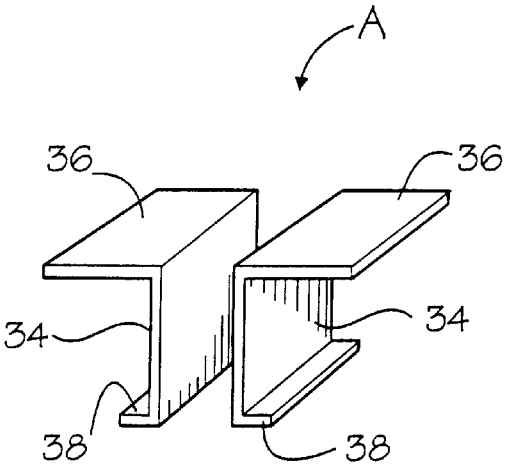
FIG. 4*a* is a detailed perspective view of the clip used in FIG. 3*a;*
Figure 4B:
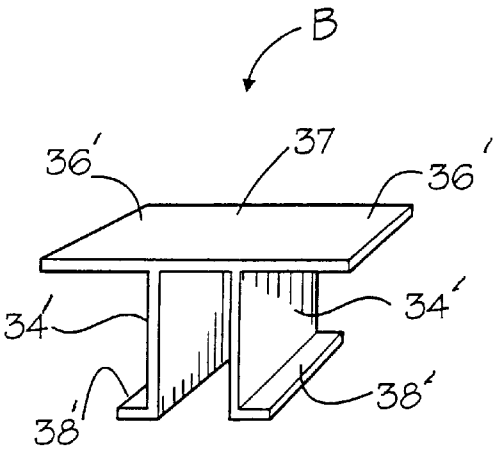
FIG. 4*b* is a detailed perspective view of the clip used in FIG. 3*b*; and, FIG. 4*c* is a detailed perspective view of the clip used in FIG. 3*c*.
Figure 4C:
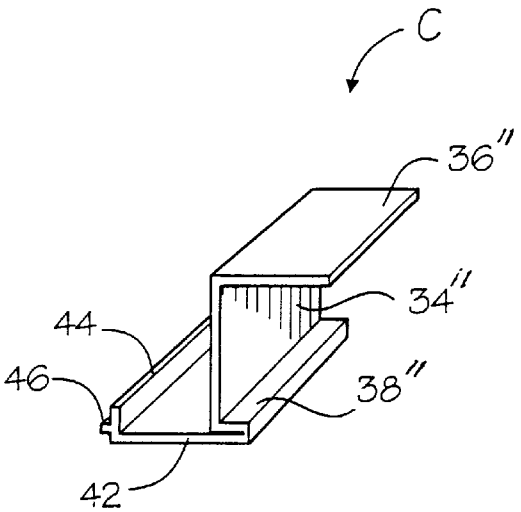

Securing clips of the type shown in FIGS. 4*a–c* are utilized to secure the flooring structure with the base floor.

Figure 3A:
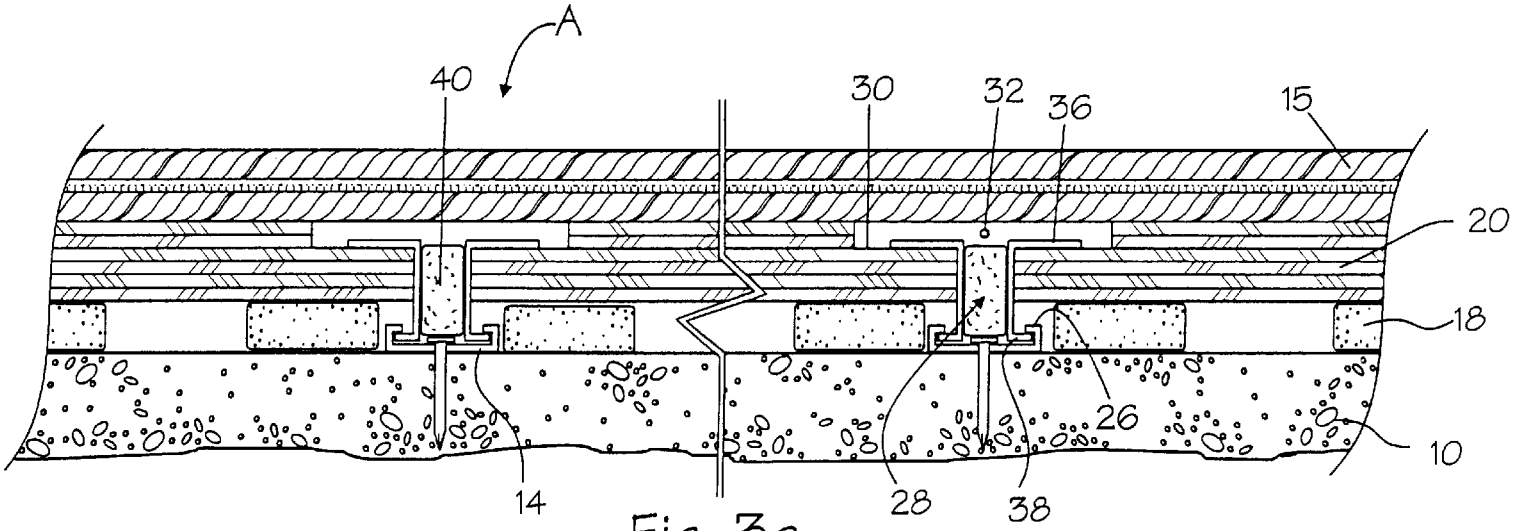
FIG. 3*a* is a side sectional view of the arrangement shown in FIG. 2.

Specifically referring to FIG. 4*a*, clip A comprises a pair of securing members which are of the type used in the flooring system shown in FIGS. 2 and 3*a*. Each member of clip A is formed at between 3" and 18" long, comprises a linear body 34 which mounts finger 36 at its upper end transversely of the body member. Foot 38 extends from the lower end of body 34 in parallel and in the same direction as finger 36. Clip A is formed of preferably 18 gauge steel with each body 34 being slightly less than 1" in length, each finger 36 being about ¾" in length, and foot 38 being slightly less than ⅛" in length. It is desirable that when foot 38 is engaged beneath rail 26 that the inner face of the rail be adjacent to or in engagement with the associated body 34. Also, fingers 36 should extend over shoulders 30 a distance just short of its end. Each body 34 should be of a length to maintain the sub-flooring panels against resilient members 18 under slight pressure. Turning now to FIG. 3*a*, a clip A is shown positioned in each slot 28 located between opposed ends of the sub-floor panels. Each foot 38 is engaged beneath rail 26 and each finger 36 extends into groove 32 and over and into contact with a shoulder 30. Clips A may be arranged back to back or staggered in opposed directions along channel members. Spacers 40, which may comprise resilient strips or fiber board strips, are positioned 28 between clips A to fill channel 28 and to retain the clips in position.

In a second embodiment, shown in FIG. 4*b*, clip B is shown as a unitary member comprising a pair of body members 34' each carrying a finger 36' at its upper end and a foot 38' at its lower end. An extension 37 interconnects the opposed fingers at upper ends of body members 34. Extension 37 is about ¾" in length and acts to resiliently separate body members 34'. Clip B is constructed of the same material and is dimensioned as is clip A.

Figure 3B:
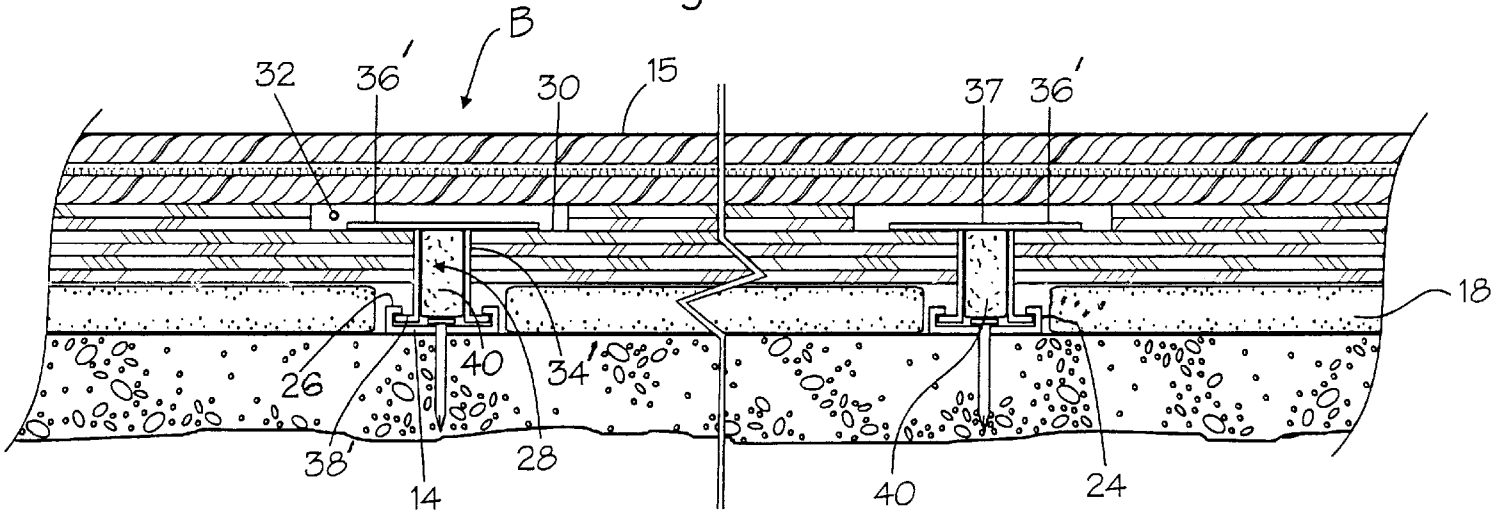
FIG. 3*b* is a side sectional view of a second arrangement of the resilient flooring structure of the invention.

In use, as shown in FIG. 3*b*, clip B is positioned in slot 28 with its feet 38' hooked beneath rails 26 of channel members 14 and with fingers 36' extending over and engaging shoulder 30. A resilient spacer 40 may be located between body members 34', as shown in FIG. 3*b*.

Figure 3C:
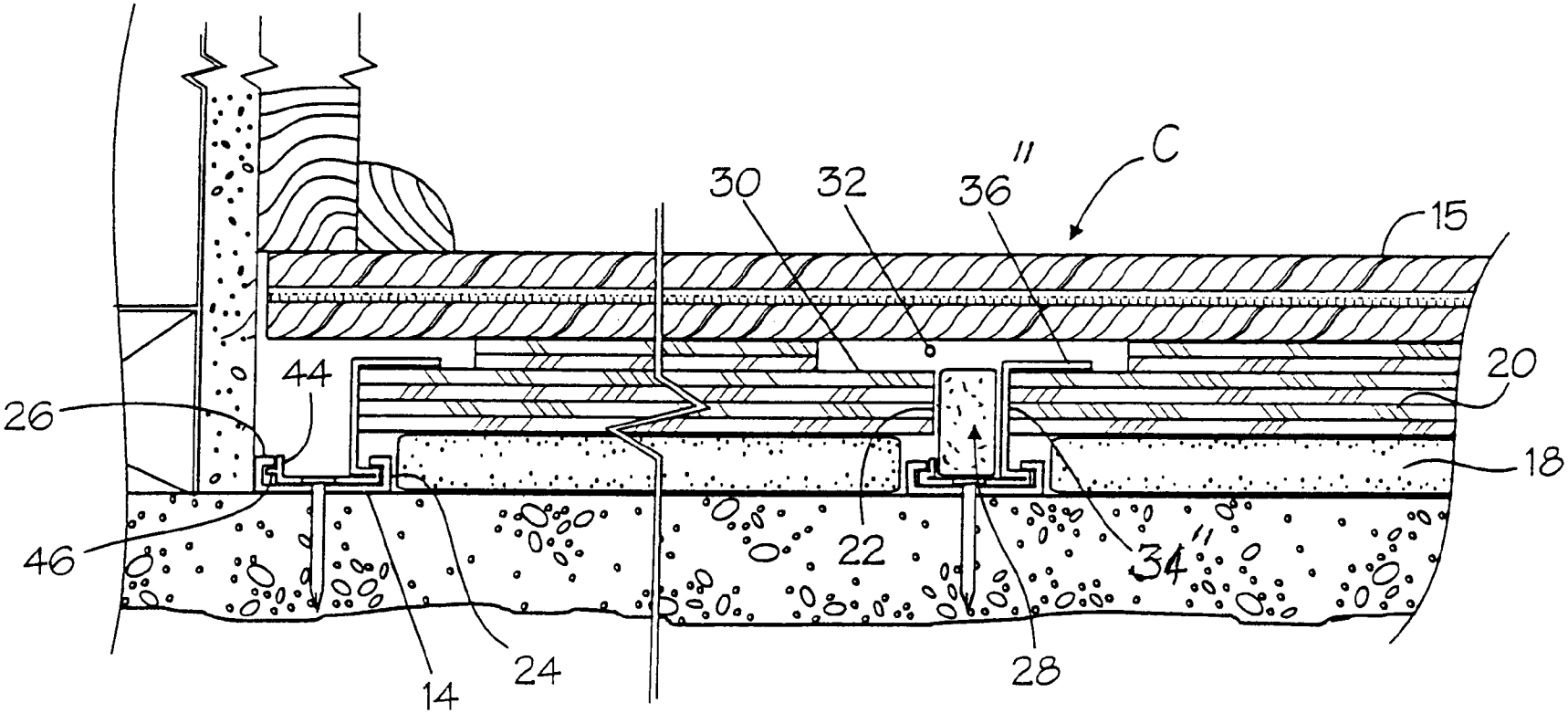
FIG. 3*c* is a side sectional view of a third arrangement of the resilient flooring system of the invention.

In the third embodiment, shown in FIGS. 3*c* and 4*c*, clip C is constructed to have body 34", finger 36", and foot 38". A leg 42 is connected with the outer end of foot 38" and arranged to extend parallel with the foot and finger 36" away from the back side of body 34". A vertical extension 44 is formed on the other end of leg 42 with an outwardly directed spur 46 formed on its outer side. Extension 44 is about ¾" laterally spaced from body 34 and spur 46 has its upper surface parallel with the upper surface of foot 38.

In use, as shown in FIG. 3*c*, clip C is positioned in slot 28 with body 34" in engagement with an end of opposed ends 22 of sub-flooring panel 20. Finger 36" is positioned over and engaged with shoulder 30 of the associated panel 20 and foot 38" is beneath a first of the rails 26 of channel member 14. Leg 42 spans the channel formed in channel member 14 so that extension 44 is positioned against the face of the opposing rail 26 with spur 46 located beneath that rail. Clips C are arranged in staggered or alternating fashion along channel member 14 and a spacer may or may not be utilized as desired.

It is noted that leg 42 may commence at the base of body 34" if desired.

It is clear that the securing as described can be used with a first laid flooring cover system. More importantly, it can be used with increased economy with a replacement floor covering system.

In use, clips A, B, or C act to limit the upward movement of the flooring system brought about by resilient members 18 urging sub-flooring panels upwardly. The fingers which are in engagement with the shoulders prohibit movement of the sub-flooring panels beyond the position of the fingers. Groove 32 formed between the base of flooring 15 and shoulders 30 provide space for downward movement of the flooring system when pressure causes resilient members 18 to be compressed.

While a preferred embodiment of the invention has been described using specific terms, such description is for illustrative purposes only, and it is to be understood that changes and variations may be made without departing from the spirit or scope of the following claims.

What is claimed is:

1. A resilient flooring formed over a base floor comprising:

a plurality of parallel spaced channel members secured with said base floor, each said channel member forming a channel, said channel member including a base, spaced vertical sides and an inwardly directed rail secured at upper ends of each of said sides, inner ends of said rails defining an opening into said channel;

at least one resilient member positioned between adjacent of said channel members;

sub-floor panels arranged between said channel members and supported by said resilient members;

opposed ends of said sub-floor panels adjacent said channel members having a recessed shoulder formed transversely thereof, adjacent of said shoulders forming a groove across said sub-floor panels;

flooring strips secured with said sub-floor panels transversely of said grooves forming a flooring surface;

clips engaging with said rails of said channel members and said shoulders of said sub-flooring panels, said clips acting to secure said resilient flooring in a maximum position away from said base floor while allowing movement toward said base floor.

2. The resilient flooring of claim 1 wherein said clips are spaced along said channels by between 6" and 24".

3. The resilient flooring of claim 1 wherein each said clip comprises a linear body having a perpendicularly directed finger at its upper end and a perpendicularly directed foot at its lower end, said finger being adapted to engage over said shoulder of an adjacent of said sub-floor panels and said foot being adapted to engage under a first rail of said rails of said sub-floor panel.

4. The resilient flooring of claim 1 wherein said finger and said foot extend in the same direction away from said body.

5. The resilient flooring of claim 2 wherein said clips each comprise opposed pairs of securing members separated by a spacer.

6. The resilient flooring of claim 5 wherein said spacer comprises a strip of one of foam and fiber board.

7. The resilient flooring of claim 3 wherein each said clip includes a lower leg extending perpendicularly of said body adjacent said lower end and in a direction opposite the direction of extension of said foot, a vertical extension connected with an end of said leg remote said foot and an outwardly directed spur formed along said leg;

said clip securing with said channel member with said foot positioned beneath said first of said rails and said spur beneath a second of said rails with said body and vertical extension in engagement with said inner faces.

8. The resilient flooring of claim 7 wherein said clips are staggered along said channel members with alternate of said clips engaging with said shoulders of alternate ones of said opposed of said sub-floor panels.

9. The resilient flooring of claim 1 wherein said clips are formed of 18 gauge steel.

10. The resilient flooring of claim 1 wherein said base floor is concrete.

11. The resilient flooring of claim 1 wherein said base floor is concrete covered with fiber board.

12. The resilient flooring of claim 1 wherein each said clip comprises a pair of spaced linear body members engaged at a first end with an extension which laterally and resiliently separates said body members, a perpendicularly disposed finger extending from said first end of each said body member in axial alignment with said extension, a foot extending from a second end of each said body member in parallel alignment with said fingers, said clips securing said resilient flooring with said base floor as each of said feet are engaged beneath said rails of said channel members and each of said fingers are engaged with said shoulders of opposed sub-floor panels.

13. The resilient flooring of claim 12 including a resilient spacer between said body members.

14. A resilient flooring assembled on a base floor comprising:

a plurality of sub-floor sections carried above said base floor;

a recessed shoulder formed across adjacent ends of said sub-floor sections;

a slot having a widened upper groove defined between said adjacent ends of said sub-floor sections;

an elongated channel member positioned within each said slot and below each said groove, said channel members being secured to said base floor;

flooring strips secured with and extending across said sub-floor sections and said channel members;

resilient members supporting and urging said sub-floor sections and said flooring strips in an upward direction;

attachment clips for attaching said sub-floor sections with said channel members, each of said clips having a body with a perpendicularly extending finger at a first end and a perpendicularly extending foot at a second end, each said foot being adapted to engage with a respective of said channel members and each said finger being adapted to extend into a respective of said grooves and into engagement with the associated of said shoulders of said sub-floor panels; whereby, said channel members and clips limit upward movement of said sub-floor sections and said flooring strips against said upward urging of said resilient members while allowing downward movement thereof.

15. The resilient flooring of claim 14 wherein each said finger and each said foot extend from said body in the same direction.

16. The resilient flooring of claim 15 wherein said clips are arranged to engage with alternate of said sub-floor panels along each said channel member.

17. The resilient flooring of claim 16 wherein a spacer is provided in said channel between said alternating clips.

18. The resilient flooring of claim 14 wherein each said channel member includes first and second upper rims and each said clip includes a leg parallel with said foot and extending in the opposite direction, said leg including a vertical extension carrying a spur; wherein, said clips are attached to said channel members with said foot hooked beneath said first rail and said spur hooked beneath said second rim.

19. The resilient flooring of claim 14 wherein each of said clips comprises two body members interconnected at said first end with an extension.

20. The resilient flooring of claim 19 wherein said fingers and said extension extend along a common axis.

21. The resilient flooring of claim 19 wherein said clips are formed of resilient metal.

22. A method of replacing a flooring system with a resilient flooring system, said flooring system comprising a base floor, channel members secured with said base floor, flooring strips laid over said base floor and said channel members and clips connecting with said channel members and said flooring strips holding said flooring strips in position; said method comprising:

removing said flooring strips;

removing said clips;

positioning resilient members between said channel members;

positioning sub-flooring panels over said channel members in end-to-end relationship forming a slot between adjacent of said ends;

engaging clips with said channel members and adjacent of said ends securing said sub-floor panels over said resilient members relative to said base floor;

securing flooring strips with said sub-floor panels; whereby, said clips fix said sub-flooring panels and said flooring strips in an upward vertical position against pressure from said resilient members while said resilient members act to allow downward vertical movement of said sub-flooring panels and flooring strips under pressure.

* * * * *